US006659336B2

(12) United States Patent
Brennan

(10) Patent No.: US 6,659,336 B2
(45) Date of Patent: Dec. 9, 2003

(54) HORIZONTAL CONTAINER FOR THE HANDLING OF FLAT OBJECTS

(76) Inventor: William J Brennan, 1308 Arrowhead Dr., Brentwood, TN (US) 37027

( * ) Notice: Subject to any disclaimer, the term of this patent is extended or adjusted under 35 U.S.C. 154(b) by 0 days.

(21) Appl. No.: 09/819,471

(22) Filed: Mar. 28, 2001

(65) Prior Publication Data

US 2002/0170948 A1 Nov. 21, 2002

(51) Int. Cl.[7] ..... B65D 27/00
(52) U.S. Cl. ..... 229/67.1; 229/67.4; 206/425
(58) Field of Search ..... 229/67.1, 67.2, 229/67.3, 67.4; 206/425; 281/45, 151; 402/73

(56) References Cited

U.S. PATENT DOCUMENTS

| | | | | |
|---|---|---|---|---|
| 292,484 A | * | 1/1884 | Gross | 229/67.3 |
| 972,302 A | | 10/1910 | Waller | |
| 1,021,598 A | * | 3/1912 | Harrington | 150/149 |
| 1,539,411 A | * | 5/1925 | Davis | 40/382 |
| 1,551,302 A | | 8/1925 | Gabel | |
| 1,721,248 A | * | 7/1929 | Davis | 40/382 |
| 2,524,965 A | | 10/1950 | Eddy | |
| 4,444,314 A | | 4/1984 | Jacobsson | |
| 4,589,544 A | | 5/1986 | Schweinberg | |
| 4,706,396 A | | 11/1987 | Nomura | |
| 4,871,066 A | | 10/1989 | LaWall | |
| 5,620,133 A | * | 4/1997 | Isserstedt | 229/67.1 |
| 5,741,028 A | | 4/1998 | Hatano et al. | |
| 6,065,616 A | * | 5/2000 | Velles | 211/55 |
| 6,360,890 B1 | | 3/2002 | Proffit | |

FOREIGN PATENT DOCUMENTS

| | | |
|---|---|---|
| JP | 2001-204528 | 7/2001 |
| WO | WO 01/54533 | 1/2001 |

* cited by examiner

*Primary Examiner*—Jes F. Pascua

(57) ABSTRACT

A horizontally extendable and contractible container for handling relatively flat objects. The container comprises a plurality of receptacles interconnected in series. A single receptacle has the capacity to store a relatively flat object or a plurality of flat objects. The receptacles are formed as open sided pockets, allowing for a wide range of object thicknesses to be contained. The facing walls of the receptacles are absent of any protrusions or holes that could inhibit an object during the insertion of the object. When transportation of the container is desired, a flap on the back most panel is wrapped over the top of the container and an elastic strap secures the container and the contained objects for transportation. A sliding mechanism, substantially isolated from the contained objects is fully integrated into the design of the receptacles and provides the necessary functionality to horizontally extend and contract the container. The primary purpose of the container is to aid in the storing and handling of relatively flat objects, especially paper documents that can normally be found horizontally on a desktop in a shingled format, although the container is applicable to the storage and handling of a wide range of relatively flat objects such as disks, CDs, pictures, microfilm and the like.

17 Claims, 4 Drawing Sheets

HORIZONTAL CONTAINER FOR THE HANDLING OF FLAT OBJECTS

REFERENCES FOR CONSIDERATION

| | | |
|---|---|---|
| 972,302 | October 1910 | Wailer |
| 1,551,302 | August 1925 | Gabel |
| 2,524,965 | October 1950 | Eddy |
| 4,444,314 | April 1984 | Jacobsson |
| 4,589,544 | May 1986 | Schweinsberg |
| 4,706,396 | November 1987 | Nomura |
| 4,871,066 | October 1989 | LaWall |
| 5,741,028 | April 1998 | Hatano |

BACKGROUND OF INVENTION

It is not uncommon to see on a desktop multiple individual documents, such as letters, contracts, reports, articles, etc. shingled or stair-stepped (shingling) in such a way that one document horizontally overlays then next with a small offset so as to expose only the top part of each document. This traditional practice is sometimes known as shingling and requires nothing to accomplish, other than a relatively flat surface and the presence of relatively flat objects to be shingled.

Shingling has the advantage of allowing the user to hold many more documents on the desktop than would be possible if the documents were laid end to end, and shingling has the advantage over evenly stacked documents, as shingling allows for the quick recognition and selection of a desired document.

This Inventor was one of those business people who frequently horizontally shingled documents on his desk. However, he was consistently frustrated with some of the major limitations inherent in shingling, specifically:

1.) How quickly the shingled pile seemed to get out of order or out of the original evenly spaced shingled format when documents were selected and removed from the shingled pile. This fact, resulted in the expenditure of time and effort to maintain the original shingled format, and;

2.) The difficulty in transporting a shingled pile, resulting in the necessity to contract the shingled pile before transporting and then re-extend the documents back into a shingled form after transportation, again taking much time and energy to recreate the shingled format.

This Inventor set out in search of a container that would solve the above two limitations. Having searched multiple office supply sources, with no solution found, the inventor turned to the patent office to see if anyone had ever developed a container to improve the handling of horizontally shingled documents.

Again, no solution was found. Although the patent office showed several types of extending filing systems, none of them were designed, nor met the needs for handling and transporting horizontally shingled documents commonly found on desktops.

To be successful in the handling and transporting of horizontally shingled documents, several goals would need to be met, and several prior art limitations and disadvantages would need to be overcome.

THE PRIOR ART

No other prior art reviewed incorporates all of the features and benefits of the present invention. Also, the prior art contains limitations and disadvantages that are overcome by the present invention, some examples of the prior arts limitations and disadvantages include:

a. Sealed receptacle sides
b. Protrusions or holes on the facing walls of a receptacle
c. Document contact with a sliding panel or the sliding mechanism
d. Requirement of a separate rigid casing or fixed sized cover
e. Lack of a securing device
f. Securing device is not easily adjustable to a wide variety of thicknesses
g. Cost is higher, resulting from the number of parts, material type and fabrication cost.

In sum, none of the prior art descriptions state that they were invented for the purpose of improving the handling, transportation and re-shingling of horizontally shingled documents commonly found on desktops; in fact, the majority refer to either vertical operation and/or a hanging orientation of the inventions.

U.S. Pat. No. 4,706,396 Nomura a. Nomura describes a bag with three sealed sides, as opposed to present invention's one closed side.
b. Given the fixed length of the wrap around cover, the number of bags is restricted to that which can be enclosed within the fixed length cover. Conversely, present invention uses separate back and front covers to allow for a wide range of thicknesses.
c. Nomura's outer cover requires full opening, and thus a preset amount of space before bags can commence sliding.
d. Nomura requires the addition of a third connecting element for the purpose of attaching one bag to another. Present invention requires no such third element, significantly reducing material and manufacturing cost.
e. As a bag becomes full, insertion and extraction of additional objects becomes increasing difficult and eventually insertion is restricted by the maximum capacity of the bag. Present invention has no sides, thus allowing a much greater range of capacity.
f. Bags are physically connected, thus separation of bags and/or reorganization is not possible. Present invention allows the user to reorganize, add or subtract receptacles.
g. Nomura describes the requirement of plastic material to create the invention. Present invention has no such limitation of material type and thus allows for flexibility to use materials of less cost.
h. Nomura's requires the front and back bags to be attached to the cover. Present invention integrates functional receptacles into both the back and front panels of the cover.

U.S. Pat. No. 4,871,066 LaWall a. LaWall also describes a pocket with three sealed sides.
b. LaWall describes the preferred embodiment as a vertical operation not horizontal.
c. LaWall's individual pockets show no protection from reverse force movement that would result in his invention's unintentional disposition or disassembly.
d. As a pocket becomes full, insertion and extraction of additional objects becomes increasing difficult and eventually restricted to the maximum width of the pocket.
e. Attempted horizontal usage would cause an angled disposition of each of the pockets, placing excessive stress on the telescoping mechanism resulting in difficulty when attempting to return the invention to registry.

f. Finally, attempted horizontal usage would cause the envelopes to come in contact with the enclosed documents during the telescoping process, resulting in friction on the enclosed documents that would result in movement of the documents and the loss of the desired evenly shingled format.

U.S. Pat. No. 44,444,314 Jacobsson a. Jacobsson describes the need for an outer box like case to contain the pocket like receptacles. An outer box like case is more expensive in terms of both the type of material required and the additional manufacturing process. Also, a fixed size case limits the total capacity to the width of the case.

b. Jacobsson describes the design of the folders' movement in terms of vertical operation, not horizontally.

c. Jacobsson requires additional intermediate coupling and sliding members, and an inner cover enclosing, thus increasing the material and manufacturing costs.

d. The internal walls of Jacobsson's pockets contain both protrusions and openings that would inhibit the smooth slide of a document during insertion, if horizontal operation was attempted.

U.S. Pat. No. 4,589,544 Schweinsberg a. Schweinsberg describes a pocket with three sealed sides.

b. The invention has no housing or cover wrap that would allow the unit to easily protect any exposed objects during transportation.

c. The lack of a cover wrap also allows contained objects to slide out during transportation, thus severely limiting the suitability of using the invention for the transportation of contained objects.

d. Further, the lack of a cover wrap allows for the potential of unintentional displacement of the folders while in transportation.

e. Single internally centered tongues and tapered flaps result in poor lateral stability, i.e. the ease of keeping alignment with the proceeding folder becomes increasing difficult as folders are added.

f. The openings, created by the tongues, in the folders' walls and the tabs on the tongues are likely to catch or snag a document as it is inserted into a folder.

g. As a pocket becomes full, insertion and extraction of additional objects becomes increasing difficult and eventually insertion is restricted by the maximum capacity of the pocket.

h. Schweinsberg describes the invention in terms of vertical operation and/or an accordion type of movement, not horizontal. Attempted horizontal usage would cause parts of the pockets to come in contact with the enclosed objects during the displacement process, resulting in friction on the enclosed objects and thus movement of the objects away from the desired evenly shingled format.

Card/Index Systems

Multiple prior art examples can be found in the area of card files. In the prior art of card files, the cards are not described as a method to hold other objects containing information, but the cards themselves are the bearer of said information.

Some of these card systems even telescope, but because they lack a true full bottom between each card, a method of holding an independent object is not feasible, nor does the prior art inventions describe that they were designed for such a purpose. As seen in Eddy, U.S. Pat. No. 2,524,965; Gabel, U.S. Pat. No. 1,551,302 and Waller, U.S. Pat. No. 972,302.

U.S. Pat. No. 5,741,028 Hatano a. The invention describes envelopes with three closed sides.

b. Invention requires a separate rigid case for protected transportation and to support the extensions of the envelopes.

c. Hatano describes the design of the folders' movement in terms of vertical operation, not horizontally d. An outer box-like case is more expensive in terms of both the type of material required and the additional manufacturing process.

e. A rigid case restricts the maximum capacity that it can hold.

f. As an envelope becomes full, insertion and extraction of additional objects becomes increasing difficult and eventually insertion is restricted by the maximum capacity of the envelope.

g. Attempted horizontal usage would cause parts of the pockets to come in contact with the enclosed objects during the extension process, resulting in friction on the enclosed objects and thus movement of the objects away from the desired evenly shingled format.

h. The invention describes no protection from reverse operation and thus unintentional disassembly is likely.

SUMMARY

This inventor's aim was to economically provide a container that would aid in the overall handling of documents, normally found in a horizontally shingled format on desktops. Specifically, to provide for the convenient; inserting, extracting, shielding, storing, spacing, contracting, securing, protecting, transporting and re-shingling of the documents, all the while keeping the documents substantially free from shifting in their receptacles, so that the desired shingled spacing is maintained.

To be successful in this aim, several goals would need to be met:

a. It was a goal that the facing internal walls of the receptacles would be free from any protrusions or holes that could interfere with or inhibit the smooth glide of a horizontally oriented document into the bottom of a receptacle. This smooth wall goal had to support angled insertion and variable sizes of the documents being inserted. This goal became especially challenging for the back most receptacle, as it contained protrusions created by the elastic strap used in securing the unit, and thus in order to keep the last receptacle functional, an additional covering tab needed to be developed.

b. In traditional shingling, a user is not restricted by a preset maximum number of pages, documents or groups of documents, i.e. no preset limit on the thickness of any one shingle in a shingled pile. Thus, a traditional receptacle sealed on three sides would not work; as such receptacles have a maximum preset capacity. This resulted in the goal for an open sided receptacle that could accommodate documents with a wide range of thicknesses.

c. Also, an open sided receptacle would more closely match the method documents are traditionally inserted into a traditional shingled pile i.e. the user normally begins the insertion at an angle to the shingled pile, and thus an open sided receptacle satisfied this goal.

d. Further, resistance in insertion and extraction of documents increases as a sealed three-sided receptacle reaches its maximum capacity. This resistance is not experienced with traditional shingling and thus an open sided receptacle removed this serious limitation.

e. A final benefit of an open sided receptacle was the ability to continue the traditional viewing advantage inherent in shingling, that is, of being able to quickly view a partially covered document by simply lifting, at an angle, the preceding document. This action is significantly easier and faster than having to extract and then possibly return a document, as would be necessary with a sealed three-sided receptacle.

f. However, the elimination of sealed sides on a receptacle, also introduced new challenges, such as the goal to securely hold enclosed documents during transportation of the container, else documents may slide out one of the open sides. This challenge resulted in a comprehensive design for a securing device that simultaneously; contains all sides of the container, sandwiches the documents, is easy to use and has the ability to adjust to a wide range of container thicknesses.

g. A key goal and design challenge was that a document must be kept almost completely isolated from any part of the sliding mechanism, as contact with a moving sliding mechanism during extension will cause a horizontally stored piece of paper to shift or move away from the bottom of the pocket, resulting in a loss of the desired evenly spaced shingled format.

h. In a traditional shingled pile, made up of mostly white papers, it can become difficult to quickly identify the separation points between the shingles. Thus, a goal was to create dividers that extended beyond the top edge of a document and provided a visual delineation between shingled documents.

i. Given that traditional shingling is "free", i.e. an external device is not required to shingle documents, it was a goal to be able to produce the container at relatively low costs and introduce advantages over traditional shingling. The result was a design that is the lowest cost container for document handling, as compared to any of the prior arts.

j. The goal of low cost, also drove the need to select low cost materials, limit the number of different types of material used and limit the number of parts required to create the container. The result of these goals was: paper, 3 and 2 respectively.

k. The goal of low cost also drove the need to create a design that could be produced by standard industry mechanized equipment. The result was a design that can be fabricated almost completely by standard die stamping and standard folding and gluing equipment.

l. Maximum design efficiency and simplicity was another goal. Given that the general goal was the handling of documents, any part or piece that did not perform this function, was minimized. Conversely, many prior art designs contain separate coupling members, separate sliding panels, a need for an exterior box, the loss of a receptacle due to the attaching of the covering panel to a receptacle, a more expensive covering panel. The result of this maximum efficiency goal resulted in a container that only requires a total of three panels as the main elements of a container. Examples of this efficiency include; every panel can hold a document, i.e. the first and last panels are not used up for connection to a covering panel. This was accomplished by the integration of the sliding mechanics with the panel and the panels and the covering panel all utilize the same sliding mechanism. None of the prior art achieved this level of efficiency, except for maybe Schweinsberg, but even this would not directly compare as he does not incorporate a covering panel or securing device for transportation.

m. As in traditional shingling, the overall length of a shingled pile is only limited by desktop space. It was thus a goal that any desired number of pockets could be connected together in series. This goal put unique demands on the covering panel, as the panel could not limit the number of pockets or the overall thickness of the container. The result was a covering panel with separate front and back panels. By not connecting these two panels, the number of receptacles and the related thickness of the stored documents in the receptacles could vary greatly. Many of the prior art covering panels were formed from a single piece, and thus as they wrapped around the container, their capacity became limited to the preset width of the spine or backbone of the covering panel.

n. Because the number of receptacles could grow to be fairly large, it was important to engineer a sliding mechanism that had maximum lateral stability, so that the receptacles would stay in alignment when fully extended. This goal resulted in a two-part solution. First, minimizing the space between the folded edge of the track and the tab riding in the track, and second, by placing the tracks at the far edges of each panel and designing the four tabs to be spaced a maximum distance apart, created a very laterally stable structure. The structure also allowed for the use of lower cost materials, as it aided in the disbursement of stress during extending and contracting.

o. Although traditional shingling does not do much to aid in the retention of a document's position, it was a goal to provide a container that would aid in the retention of a document so that it would not shift from its position while adjacent documents were inserted or extracted from the shingled pile.

p. A goal was to protect the documents during transportation using a folding flap and securely sandwiching the documents in their receptacles, so upon re-extension of the container, the evenly spaced shingled format would be preserved.

q. It was a goal to provide predetermined stop points for the sliding mechanism in order to limit the range of movement in both directions during extension and contraction. This was a goal so as to prevent both unintended reverse displacement and/or disassembly.

r. In a traditional shingled pile, a user can grab half the pile and walk away with it leaving the other half on the desk. Thus, it was a goal that the receptacles could separate or disengage each other to allow for the movement of a subset of the shingled pile. The ability to easily disengage panels, also allows for panels to be rearranged in different orders, or combined with other panels.

s. Not found in traditional shingling, is a quick and easy way of re-shingling a pile that had been contracted. The desire for this benefit became a main design goal.

Further uses, benefits and advantages will become apparent from a review of the ensuing descriptions and drawings.

Reference Numerals in Drawings

16 Fold Lines
21 Identification Tabs
22 Slots
24 Strap
25 Holes
26 Strapping Ends
29 Flap
31 Upper Tabs
32 Lower Tabs
41 Top of the Back Most Panel
42 Folded Under Flap
44 Graspable Protrusion
45 Inserted Objects
47 Available Space
48 Raised Element
49 Pressure Points
51 Flap Body
52 Wall
53 Binding
54 Tracks
55 Side of Container
56 Upper Track
57 Lower Track
58 Bottom of Receptacle
59 Bottom of Track

DETAILED DESCRIPTIONS

Definitions and Clarifications:

a. A panel is any material being relatively flat and of one plane.

b. A panel can be folded once, to create two panels in the form of a receptacle with open sides.

c. A receptacle's two panels are sometimes referred to as a front wall and a back wall.

d. Binding is the joining of parts of a panel to itself, and in the preferred embodiment of the present invention, binding can be through the use of glue and/or tape with paper based material and sonic and/or heat welds with plastic based material.

e. The result of all folding and binding steps is a finished panel.

f. A finished panel completely folded and a finished receptacle is the same.

g. A finished container comprises a finished front panel, a plurality of finished internal panels, and a finished back panel, all interconnected.

h. A finished container is sometimes referred to as a finished unit, or unit.

i. Plastic refers to all types of plastics and polyurethanes.

j. A securing device is comprised of: a front most panel, a back most panel and separate from each other, elastic strapping attachably affixed to the back most panel, a flap on the back most panel and a raised element attachably affixed to the flap.

Internal Panel

Figure 1:
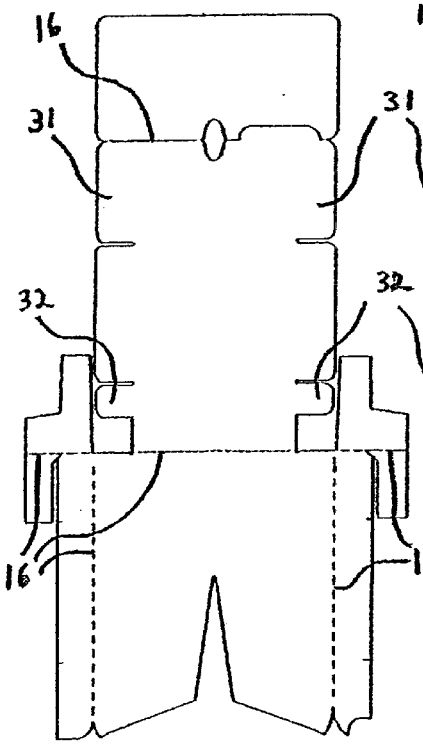
FIG. 1 shows the outline of the internal panel
Figure 4:
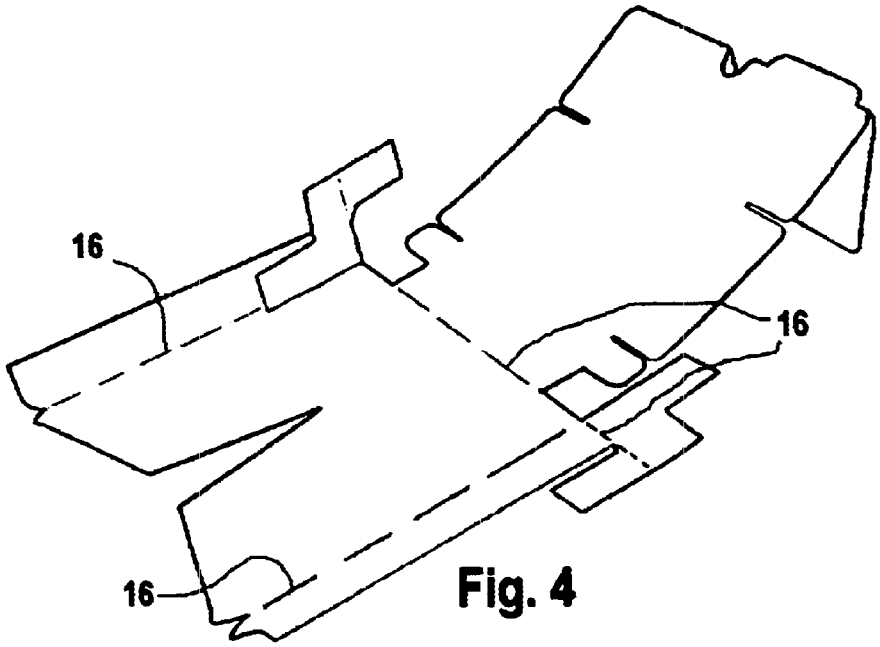
FIG. 4 shows a panel partially finished

Finishing of the internal panel starts with a relatively flat sheet of material outlined as substantially shown in FIG. 1. Folding along the fold lines 16. With folds creasing as shown in FIG. 4 and binding said folds, results in a finished internal panel, with final fold creating a receptacle with open sides, as substantially shown in FIG. 5.

Front Panel

Figure 2:
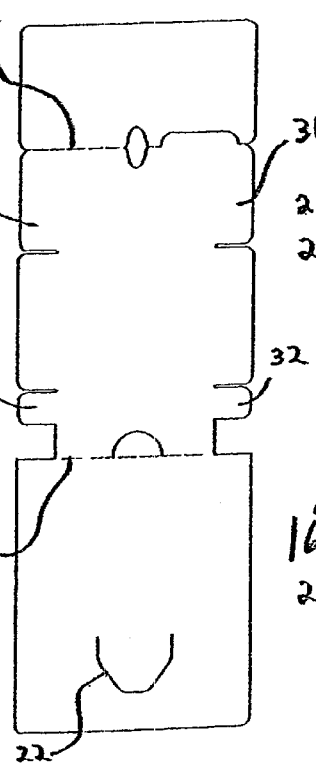
FIG. 2 shows the outline of the front panel

Finishing of the front panel starts with a relatively flat sheet of material outlined as substantially shown in FIG. 2. Folding along the fold lines 16 and binding said folds substantially similar to those steps described above for the internal panel results in a finished front panel in the form of a receptacle with open sides.

The utility of the front panel can be optionally increased by the addition of mini pockets, slots 22 or the like. These mini pockets allow for the placement of objects not suitable for a finished unit's main receptacles as shown substantially in FIG. 5.

Back Panel

Figure 3:
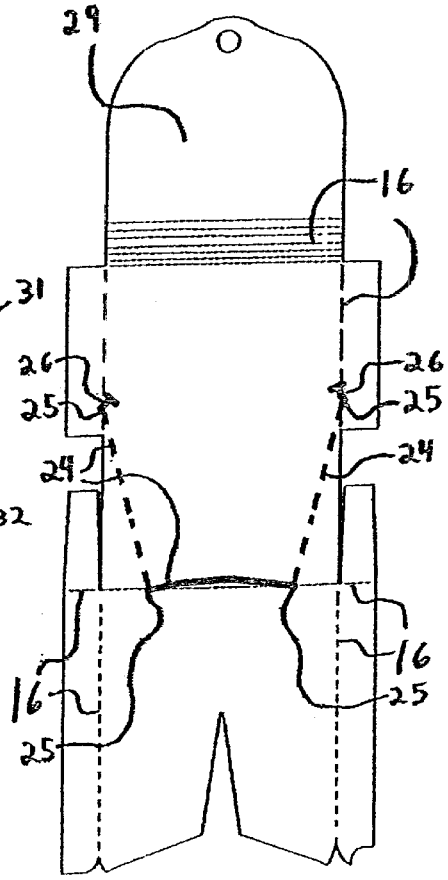
FIG. 3 shows the outline of the back panel

Finishing of the back panel starts with a relatively flat sheet of material outlined as substantially shown in FIG. 3. The finishing steps of said back panel begin with the weaving of strap 24, with the preferred embodiment of this present invention using strapping of an elastic nature, through the holes 25 in the back panel and attachably affixing the strapping ends 26 to the back panel.

Folding along the dashed lines and binding said folds substantially similar to those steps described above for the internal panel, results in a finished back panel in the form of a receptacle with open sides.

Figure 8:
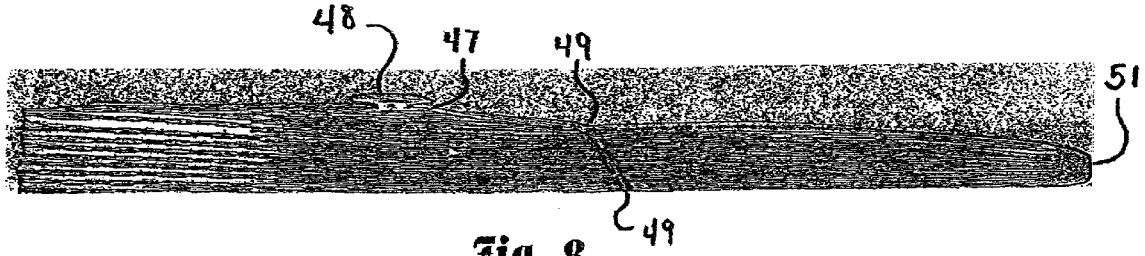
FIG. 8 shows a side view of a finished unit in its contracted and secure state.
Figure 9:
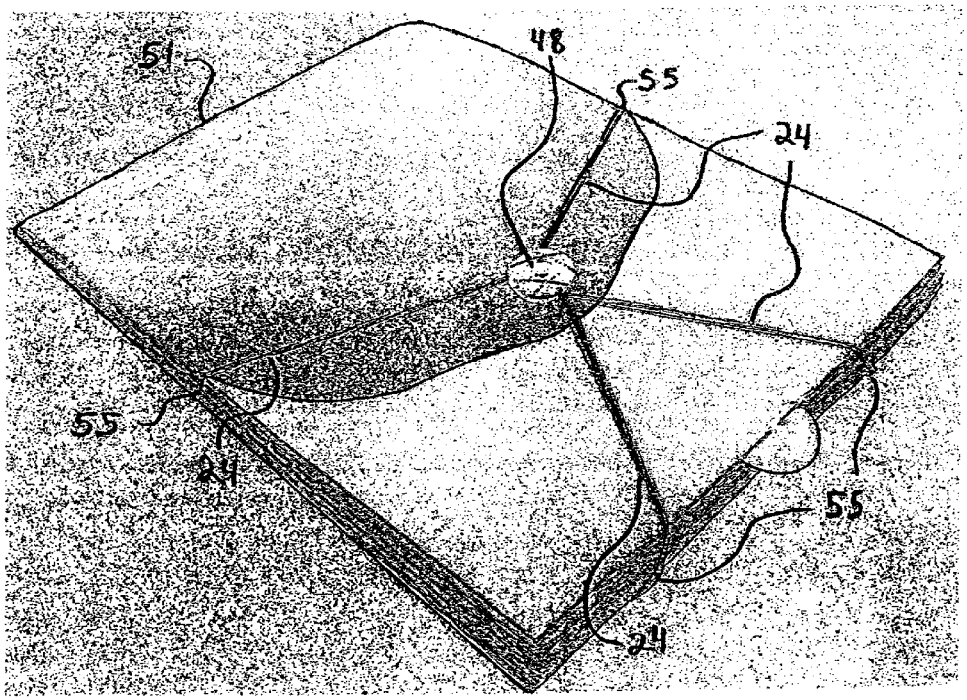
FIG. 9 shows an above-off-center view of a finished unit in its contracted and secure state.

The final step in creating a finished back panel is the connecting of a raised element 48, as substantially shown in FIGS. 8 and 9, to the flap 29 on the back panel (FIG. 3), with the preferred embodiment of the present invention, said raised element is button like, in that it contains space between itself and its point of connection to allow a strap to fit into the available space 47.

Additional Description

The main parts of the sliding mechanism are integrated into the outline of each panel as substantially shown in FIGS. 1, 2 and 3.

Figure 5:
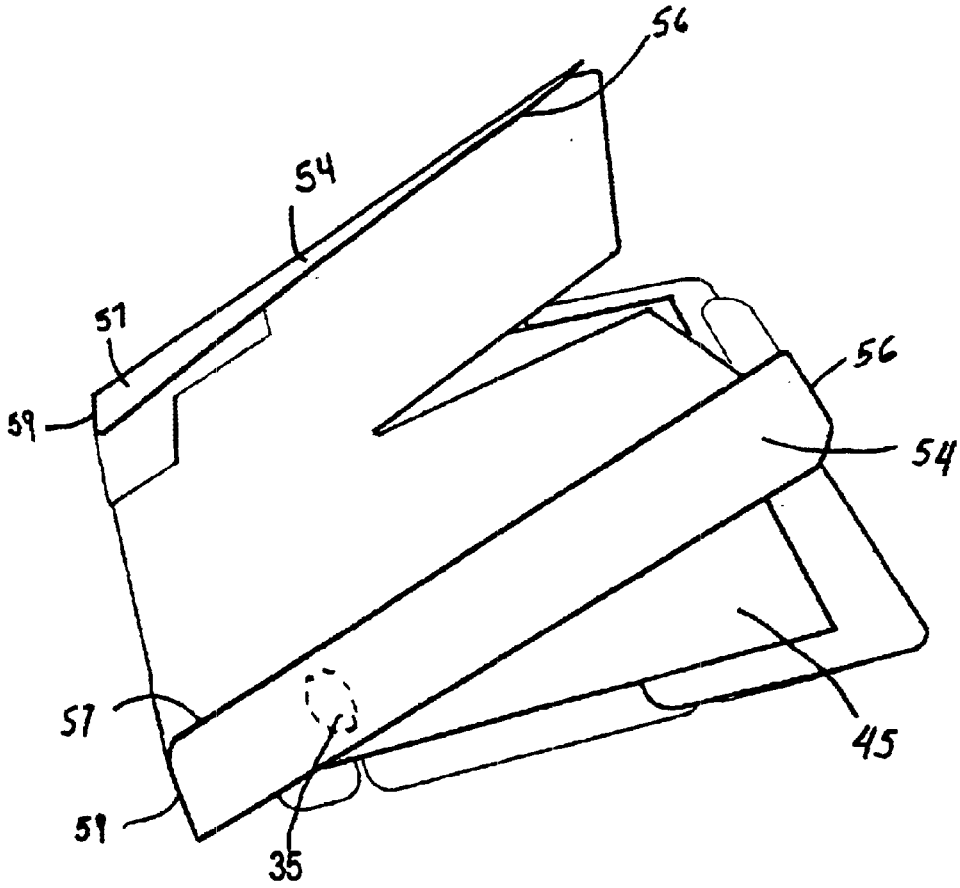
FIG. 5 shows a finished panel partially opened.

As substantially shown in FIG. 5, a combination of folding and binding creates the tracks 54 as one part of the sliding mechanism.

The four upper tabs 31 and lower tabs 32 of FIG. 2 slide along the tracks 54 when inserted into the tracks. When interconnected, the four upper tabs 31 and the tracks 54 comprise the sliding mechanism.

A combination of bottom of track 59 and binding 53 provides the positive stops to limit the range of the sliding mechanism's movement.

Assembly of Finished Panels

The finished panels, except for the first most panel, each contain two tracks 54 (FIG. 5). The finished panels, except for the back most panel, each contain four upper tabs 31 and lower tabs 32 as substantially shown in both FIG. 1 and FIG. 2.

Assembly of the finished panels into a finished unit can begin with any one of the finished panels. Assuming starting with the finished front panel, a finished internal panel is interconnected with the finished front panel by inserting the tabs into the tracks. The upper tabs 31 of the finished front panel slide down onto the top part of the upper tracks 56 (FIG. 5) and the lower tabs insert into the bottom of the two lower tracks 57 to complete the interconnection process. Ease of insertion (and/or removal) of the lower tabs is improved by temporarily arching the panel to be inserted so as to temporarily narrow the overall width of the panel.

Next, depending on the number of finished internal panels desired, additional finished internal panels are interconnected to the preceding internal finished panel using substantially the same steps as previously described above for interconnection. In the preferred embodiment, the identification tabs 21 alternates sides as substantially shown in FIG. 6. The raised identification tabs 21 allow for the labeling of individual receptacles and the alternating of the identification tabs results in uniform support of the flap body 51 (FIG. 8) when folded in the secure state. This support helps restrict the flap at its fold point from moving into an angle that is not parallel to the bottom of the unit.

Upon final interconnection of any desired number of finished internal panels, the finished back panel is interconnected to the ending finished internal panel by using substantially the same method as previously described, resulting in a finished unit.

Figure 6:
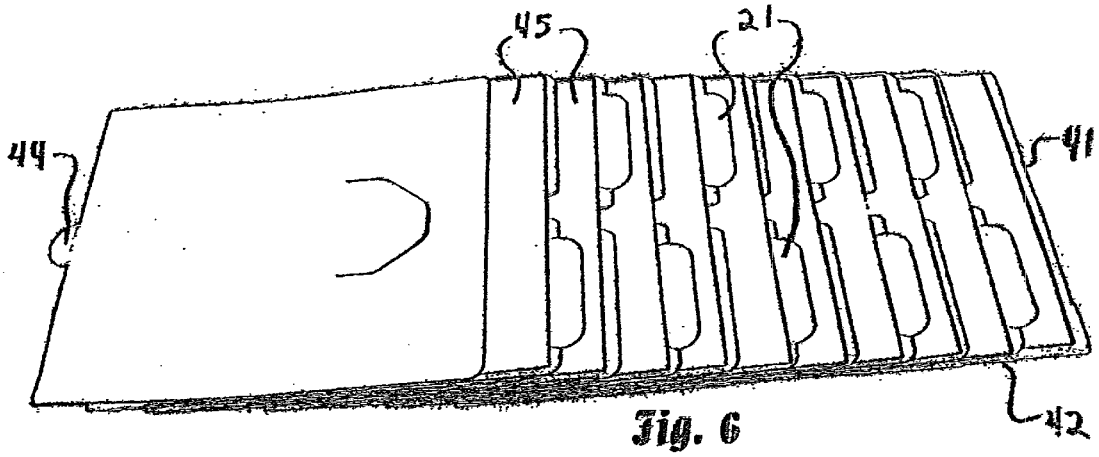
FIG. 6 shows a finished unit in its extended state

A finished unit properly assembled, can, via the sliding mechanism, extend and contract as substantially shown in FIGS. 6 and 9, respectively.

Alternative Embodiments and Ramifications

Many various possibilities exist for the present invention.

a. The present invention can be made in varying sizes and aspect ratios as the functionality and utility of the present invention remains unchanged across a plethora of dimensions.

b. By modifying the dimensions of the present invention, it can be made suitable for containing a wide range of relatively flat object types. Some examples of objects that can be contained include legal size sheets, oversized documents, disks, CDs, tapes, photographs and most any size of paper.

c. Where the preferred embodiment of the present invention is to extend from back to front of a desk, it is also possible to extend from left to right across a desktop.

d. Also the long side of a panel can be the opening side, thus allowing the left most or right most part of a document to be exposed, as opposed to the preferred embodiment, where it is the top most part of a document that is exposed.

e. The elastic strap used for securing can be more than one elastic strap and the strap(s) can be replaced by non-elastic strapping or velcro.

f. The elastic strap(s) can be attachably affixed at a multitude of different locations on the container and still satisfactorily secure the container.

g. The securing device could not have a raised element, but simply have elastic straps for securing the container.

h. Depending on the type of base material chosen, paper or plastic, and the thickness of the material, it is not a requirement of the present invention to have double layers of material where the double layers are used solely for the purpose of reinforcing specific areas of a panel and thus removal of said doubled reinforcing layers may moderately change the outline of FIGS. 1 and 2, however in no way do the changes affect the herein represented utility, functioning or functionality of the present invention.

i. Depending on the base material chosen, paper or plastic or the manufacturing process employed, the original outline of a panel, the position of a fold, or even the necessity for a specific fold can be changed without affecting the represented utility, functioning or functionality of the present invention.

j. If secure transportation of a finished unit is not desired, then a variation is possible to the preferred embodiment by not using a back panel. Non-use of the back panel would reduce material and manufacturing costs. Further for simple low cost desktop usage, it is possible to lower the cost of manufacturing even further by removing the sliding mechanism, and still offer the benefit of aiding in the creation and maintenance of evenly spaced shingling and the position retention of a document while adjacent documents are being inserted or extracted.

Other embodiments of the present invention will be apparent.

Advantages

Present invention encompasses all of the following advantages into a single present invention and mitigates or obviates many of the limitations and disadvantages found in the prior art.

These advantages and features of the present invention include:

a. Eases the handling of documents that are traditionally shingled on desktops.

b. Low materials cost, as compared to other devices in its class.

c. Low cost of manufacturing, as most fabrication processes can be mechanized on industry standard equipment.

d. Ability to receive a wide range of document thicknesses, as no preset maximum capacity is defined.

e. Designed completely for horizontal usage.

f. Aids in position retention of individual documents, even when adjacent documents are being inserted or extracted.

g. Minimizes frictional forces on the objects contained in the receptacles during the extension and contraction process, thus resisting the shifting of the objects from the desired evenly spaced shingled format.

h. Protectively and securely transports documents that originated in a shingled format.

i. Easily and quickly returns a contracted stack of documents back into an evenly spaced shingled format.

j. The present invention is completely self-contained, as the panels incorporate all the necessary requirements for the sliding mechanism to function.

k. Receptacles can be detached, reorganized or added to each other.

l. Panels are protected from sliding beyond a predetermined distance in both directions.

m. Allows for the easy review of a whole document by simply lifting the front wall of the receptacle containing the document.

n. The design of an unfinished panel incorporates self-reinforcing areas.

o. A receptacle has no protrusions or holes that could interfere with a document's insertion into a receptacle.

p. The design and placement of the tracks and tabs in the sliding mechanism provide superior lateral stability.

q. Allows for the quick and easy movement of a shingled pile from a desktop.

r. The panels provide visual delineation of the documents in separate receptacles.

s. Very functional, as every panel is an operational receptacle.

t. Very efficient, as it only takes three panel types to create a finished unit.

u. The present invention does need or require a separate rigid casing.

v. Securely protects documents with a unique securing device.

w. A unique securing device, resulting from the combination of; separate back most panel and separate frontmost panel, four sides contained by a combination of elastic strapping and flap connected to a raised element and the sandwiching pressure of the stretched elastic.

x. This securing device both secures and allows for a wide range of thicknesses, with no preset maximum.

From the description above, further usage, advantages and features of the present invention will be apparent.

Operation and Common Usage

Figure 7:
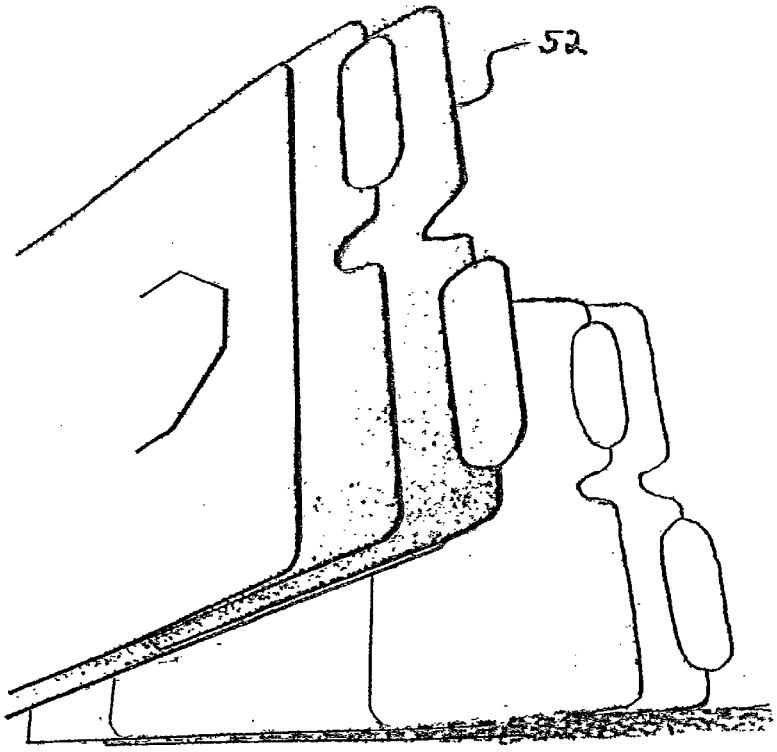
FIG. 7 shows a finished unit in its extended state with one of the receptacles opened.

As substantially shown in FIG. 7, a finished unit is comprised of a plurality of receptacles that can open across a wide range of distances to allow for the insertion of variable sized objects. When in a horizontal position, a receptacle is opened by lifting up on the front wall 52 of the receptacle.

In the preferred embodiment of the present invention, documents will be the primary objects inserted into the receptacles.

In the preferred embodiment of the present invention, and as substantially shown in FIG. 6, the flap 29 (FIG. 3) from the finished back panel folded under flap 42 when the unit is in the extended state.

When the unit is not in the secure state, objects can be identified, removed or inserted from a receptacle while the unit is in either the extended or contracted state flap open. A finished unit, slides to its full extended length, as substantially shown in FIG. 6, by grasping the graspable protrusion 44 found on the front most panel and grasping the top of the back most panel 41, and pulling in opposite directions until all panels have slid a maximum distance as predetermined by the stops in the tracks, resulting in the unit being in its extended state.

Contraction occurs when forces pressing on or near the graspable protrusion 44 and the top of the back most panel 41, in substantially the opposite direction as used for extending, continues until all receptacles become substantially flush with adjacent receptacles so as to appear that the receptacles are stacked one on top of the other, as substantially shown in FIG. 8, resulting in the unit being in its contracted state.

In the extended state, FIG. 6, the finished unit rests substantially horizontally on a desktop, table or the like.

An object can be inserted into a receptacle until the object reaches the bottom of the receptacle 58 (FIG. 5).

As substantially shown in FIG. 6, in the preferred embodiment, some part of said inserted objects 45 will remain exposed above the rim of the receptacle to allow for easy identification and grasping of said object.

The design of the present invention allows for a very wide range of object thicknesses to be received by a receptacle, as there are no sides FIG. 7 to restrict a receptacles capacity. An object is removed from a receptacle by simply grasping and pulling said object from the receptacle.

If transportation of a unit in its contracted state is desired, the flap 29 (FIG. 3) from the back most panel is brought over the top to the front most panel until the flap's body 51 meets the top (FIG. 8) of the receptacles, and the strap 24 is guided from the back most panel over the near corner to the front most panel and stretched toward the raised element. FIG. 9 shows both parts of the strap pressing against the raised element 48 in such a way that the raised element retains the stretched elastic strap from returning to its pre-stretched position, until said strap is relieved from the raised element by the user. When in the contracted state, shifting or movement of the receptacles and the objects contained by the receptacles will be inhibited by a combination of the strap 24 traversing side of container 55 of the unit, the flap's body 51 covering the top of the unit, and a sandwich effect from the squeezing pressure points 49 (FIG. 8) produced by the force inherent in an elastic strap that has been stretched.

Conclusion and Scope

Although the descriptions and drawings herein contain many specificities, these should not be construed as limiting the scope of the present invention but as merely providing illustrations of some of the presently described embodiments of this invention. Accordingly, the scope of the invention should be determined not by the embodiment(s) illustrated, but by the appended claims and their legal equivalents.

I claim:

1. A container apparatus for at least one substantially flat object, comprising:

at least a first front panel and a second back panel, each panel folded along a panel fold to form a receptacle with a front wall and a back wall, the front wall defining a front internal surface, the back wall defining a back internal surface, the front internal surface facing the back internal surface, wherein both the front internal surface and back internal surface are sufficiently planar to prevent interference with the substantially flat object being inserted into the receptacle;

the first panel defining at least one tab;

the second panel defining a track having an upper end and a lower end, the track adapted to accept the at least one tab such that the at least one tab of the first panel and the track of the second panel may be interwoven to form a connection joining a front receptacle and a back receptacle, the connection defining an integrated sliding mechanism adapted to interconnect the front receptacle to the back receptacle, wherein the upper end and lower end of the track of the sliding mechanism are adapted to provide a limited extension and a controlled stack contraction of one of the receptacles relative to the other receptacle, the first panel having a flap covering the connection of the tab and track such that said sliding mechanism is substantially isolated from the object contained by the receptacle such that the object is not affected by movement of the sliding mechanism.

2. The apparatus of claim 1 wherein said connection of the receptacles is operable in a horizontal direction.

3. The apparatus of claim 1, the front internal surface only connected to the back internal surface at a bottom of the receptacle.

4. The container of claim 1, wherein said panels are made of paper or plastic.

5. The container of claim 1, first panel having a different form from the second panel.

6. The container of claim 1, wherein said panels are substantially rectangular in shape.

7. The container of claim 1, wherein said panels are stiff enough to provide for the functioning of said sliding mechanism and supple enough to allow the panels to flex around a contained object.

8. The container of claim 1, the receptacles defining a short side and a long side, opening can be either on the short side or the long side of said container.

9. The container of claim 1, the front most receptacle further comprising a grasping protrusion at the bottom of the front panel.

10. The container of claim 1, further comprising:

a securing device attached to the second panel and adapted for securing objects in at least one receptacle.

11. The container of claim 1, the at least one tab sized to fit precisely in the track to eliminate play in the movement such that said sliding mechanism is limited to movement in two directions, with said directions being opposite of each other.

12. The container of claim 1, wherein said first panel is removably interwoven to said second panel.

13. The container of claim 1, comprising a graspable protrusion attached to the front receptacle, the graspable protrusion adapted to operate as an index tab.

14. The container of claim 13, wherein the graspable protrusion extends from the top of the container when the container is in a secured position.

15. The container of claim 1, wherein the upper end of the tracks is offset from and parallel to a line along the panel fold to aid in the even stacking of contracted receptacles.

16. The container of claim 1, wherein said flat objects can be easily accessed in both the container's contracted and extended state.

17. The container of claim 1, wherein said sliding mechanism is formed from the same panels as the receptacle.

* * * * *